US007621280B2

(12) United States Patent
Magee

(10) Patent No.: US 7,621,280 B2
(45) **Date of Patent: *Nov. 24, 2009**

(54) HAIR COLORING SYSTEM

(76) Inventor: Harvey Magee, 6233 Fjord Way, New Port Richey, FL (US) 34652

( * ) Notice: Subject to any disclaimer, the term of this patent is extended or adjusted under 35 U.S.C. 154(b) by 56 days.

This patent is subject to a terminal disclaimer.

(21) Appl. No.: 11/322,849

(22) Filed: Dec. 30, 2005

(65) Prior Publication Data

US 2006/0144415 A1 Jul. 6, 2006

Related U.S. Application Data

(63) Continuation-in-part of application No. 11/028,835, filed on Jan. 4, 2005, now abandoned.

(51) Int. Cl.
*A45D 19/18* (2006.01)

(52) U.S. Cl. ..... 132/270

(58) Field of Classification Search ..... 132/270, 132/213, 213.1, 214, 139, 150, 148, 223, 132/226, 248, 258

See application file for complete search history.

(56) References Cited

U.S. PATENT DOCUMENTS

| | | | | | |
|---|---|---|---|---|---|
| 552,480 | A * | 12/1895 | Kiel | 132/280 |
| 673,098 | A * | 4/1901 | Tissier | 132/133 |
| 2,789,565 | A * | 4/1957 | Voorhees | 132/207 |
| 3,972,075 | A * | 8/1976 | Alevras | 2/174 |
| 5,018,542 | A * | 5/1991 | Lee | 132/139 |
| 5,573,016 | A * | 11/1996 | Graves | 132/254 |
| 5,740,820 | A * | 4/1998 | Stern | 132/249 |
| 5,921,252 | A * | 7/1999 | Chubb | 132/144 |
| 6,494,214 | B1 * | 12/2002 | Coldicott | 132/213.1 |
| 7,021,317 | B1 * | 4/2006 | Nathaniel | 132/270 |

* cited by examiner

*Primary Examiner*—Robyn Doan
*Assistant Examiner*—Rachel R Steitz
(74) *Attorney, Agent, or Firm*—Edward P Dutkiewicz, P.A.

(57) ABSTRACT

A hair coloring system having a grid and associated quads. The quads are held against the scalp with a tie-down tool. Such placement allows the dyeing of hair up to the root structure. A hair manipulating tool enables a user to separate the hair into manageable quantities. The hair manipulating tool also enables the user to efficiently thread the hair strand through the quad structure.

2 Claims, 18 Drawing Sheets

FIG 63
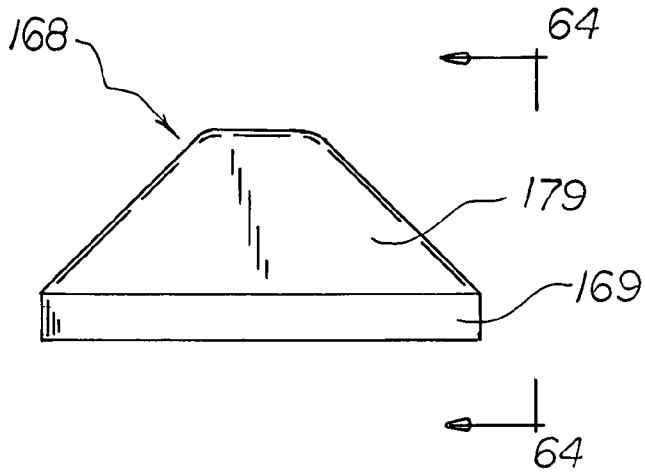
FIG 64
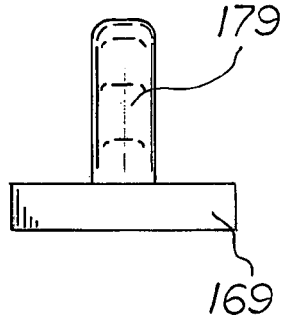
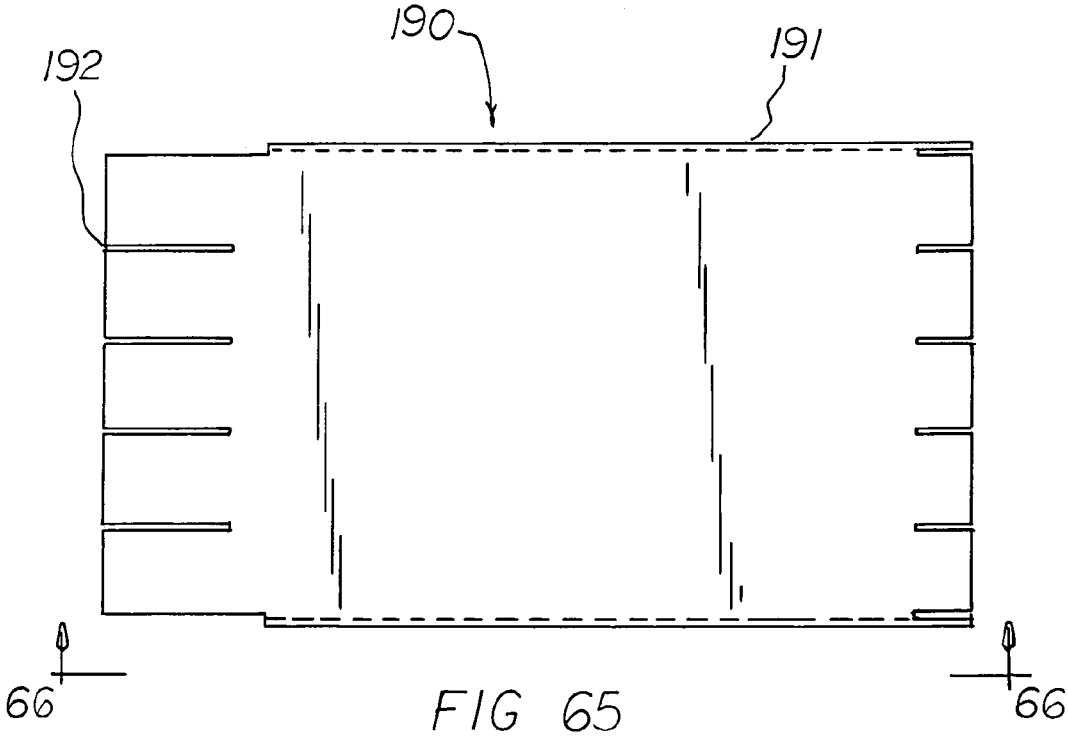
FIG 65

FIG 66
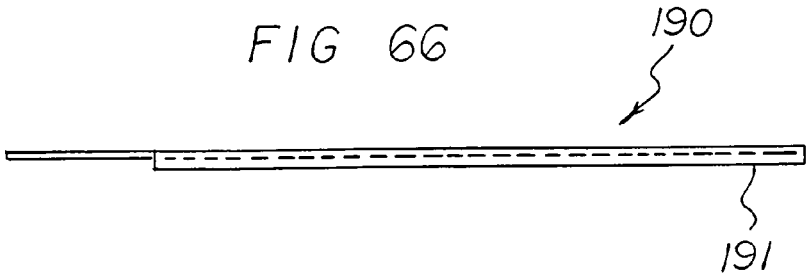
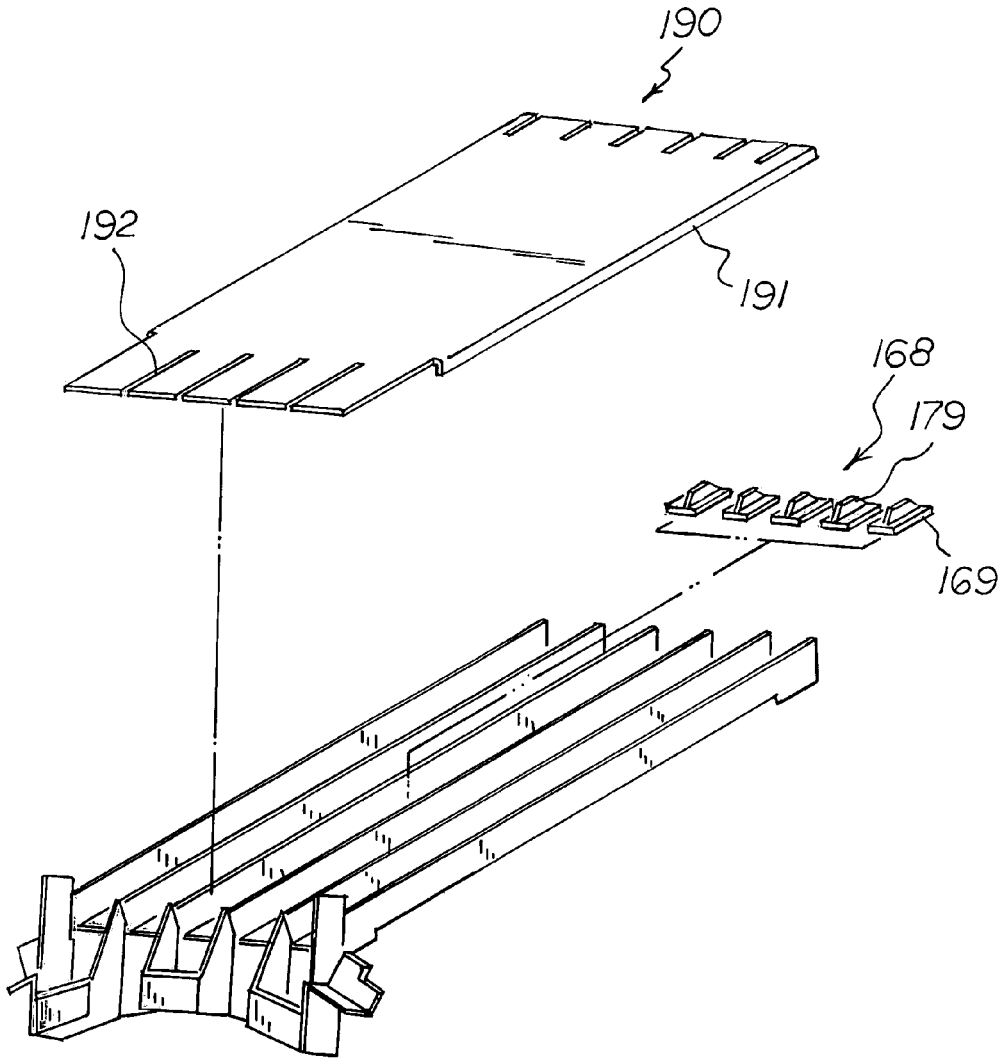
FIG 67

HAIR COLORING SYSTEM

This application is a continuation-in-part of Ser. No. 11/028,835, filed on Jan. 4, 2005, now abandoned entitled "Hair Coloring System", Applicant Harvey Magee, the subject matter of which is incorporated herein by reference.

BACKGROUND OF THE INVENTION

Background of Invention

1. Field of the Invention

The present invention relates to a hair coloring system and more particularly pertains to applying dye to hair in a safer and more precise manner.

2. Description of the Prior Art

The use of systems for coloring hair of known designs and configurations is known in the prior art. More specifically, systems for coloring hair of known designs and configurations previously devised and utilized for the purpose of coloring hair are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,819,721 issued Jan. 14, 1958 to Zakon relates to a method and apparatus for selective hair dyeing. U.S. Pat. No. 5,402,511 issued Aug. 27, 1991, to Haddad discloses an apparatus and method for selective coloring of hair. U.S. Pat. No. 5,156,172 issued Oct. 20, 1992 to Tancredi discloses a device and method for cosmetically treating hair. U.S. Pat. No. 5,349,970 issued Sep. 27, 1994 to Razzouq discloses a method for foiling hair. U.S. Pat. No. 5,469,873 issued Nov. 28, 1995, to Guth discloses a device for producing streaks in hair. U.S. Pat. No. 5,865,190 issued Feb. 2, 1999 to Butler discloses a hair grouping and separating lip apparatus and method for use in coloring alternating hair bundles. Finally, U.S. Pat. No. 6,431,181 issued Aug. 13, 2002, to Torres discloses a hair coloring cap and method of use.

While these devices fulfill their respective, particular objectives and requirements, the aforementioned patents do not describe a hair coloring system that allows applying dye to hair in a safer and more precise manner.

In this respect, the hair coloring system according to the present invention substantially departs from the conventional concepts and designs of the prior art, and in doing so provides an apparatus primarily developed for the purpose of applying dye to hair in a safer and more precise manner.

Therefore, it can be appreciated that there exists a continuing need for a new and improved hair coloring system which can be used for applying dye to hair in a safer and more precise manner. In this regard, the present invention substantially fulfills this need.

SUMMARY OF THE INVENTION

In view of the foregoing disadvantages inherent in the known types of systems for coloring hair of known designs and configurations now present in the prior art, the present invention provides an improved hair coloring system. As such, the general purpose of the present invention, which will be described subsequently in greater detail, is to provide a new and improved hair coloring system and method which has all the advantages of the prior art and none of the disadvantages.

To attain this, the present invention is a hair coloring system for applying dye to hair in a safer and more precise manner. The system essentially comprises a grid body fabricated of a flexible transparent material having a pair of end bars including a front bar and a parallel rear bar with a pair of parallel side bars there between. The front bar and the rear bar each has a top edge and a concaved bottom edge. The side bars are constructed of a plurality of paired spines each with a first spine projecting upwardly perpendicular to the side bar and a second spine having a proximal portion projecting outwardly perpendicular to the side bar. Additionally, a distal portion projects at an angle of about 45 degree from the body with the side bars having a plurality of downwardly opening recesses and a plurality of radially extending fingers forming a liner trough.

Next provided is a grid body extension fabricated of a flexible transparent material having a front bar and a pair of parallel side bars there between. The front bar has a top edge and a concaved bottom edge. The side bars are constructed of a plurality of paired spines each with a first spine projecting upwardly perpendicular to the side bar and a second spine having a proximal portion projecting outwardly perpendicular to the side bar and a distal portion projecting at an angle of about 45 degree from the body. The side bars have a plurality of downwardly opening recesses and a plurality of radially extending fingers forming a linear trough.

Next provided is a lateral coupler having a pair of linear prongs and a handle portion between the prongs. The lateral coupler has a continuous recess around the periphery. The prongs are adapted to slidably couple with the linear troughs of the grid body and the grid body extensions.

A plurality of connecters are next provided. Each connector has a generally rectilinear configuration with a pair of apertures. The apertures include a first aperture and a second aperture. Each connector is configured to couple a grid body to a grid body extension such that the first aperture is configured to receive the spine of the grid body and the second aperture configured to receive the adjacent spine of the grid body extension thereby forming an elongated grid structure.

Next provided is a plurality of union strips. Each strip has a generally linear configuration with a plurality of receiving plugs with a linear edge adjacent to the plugs. Each strip has a plurality of U-shaped indentation between the receiving plugs. The receiving plugs are configured to receive the spines of a grid body and a grid body extension and is configured to be removably coupled thereto.

Provided next is a plurality of caps. Each cap has a receiving end and a grip end. Each receiving end is configured to be removably coupled to the spines.

A hair curler apparatus is next provided. The hair curler apparatus has a hollow exterior portion of a generally cylindrical configuration and a solid interior portion of a generally frustoconical configuration and an end cap. The exterior portion has a pair of disk ends and a tapered upper part and an open bottom. The interior portion has a threaded end and the end cap has a pair of wing sides with fingers.

Next provided is a plurality of side quads. Each side quad has a support backing with a thin linear hinge receptacle and an interior end and an exterior end. The interior end has a first coupler configured to slidably couple to the second spines of the grid body and the grid body extension. The exterior end has a second coupler. The support backing has a linear top edge and a concaved bottom edge and a plurality of hair receptacles thereon. Each of the hair receptacles has fins.

Provided next is plurality of end quads. Each end quad has a support backing with a thin linear hinge receptacle and an interior end with a first coupler and an exterior end with a second coupler. The first coupler is universally configured to couple to the second coupler of the side quads and the end quads and further having a securing aperture. The support backing has a linear top edge and an concaved bottom edge and a plurality of hair receptacles thereon. Each of the hair receptacles has fins.

A plurality of central quads is next provided. Each central quad has a support backing with a thin linear hinge receptacle and a pair of side ends. The side ends each have side couplings configured to slidably couple to the first spines of the grid body and the grid body extension bilaterally. The support backing has a linear top edge and an concaved bottom edge and a plurality of hair receptacles thereon. Each of the hair receptacles has fins.

Next provided is a plurality of removable hair receptacles having a generally rectangular interior configuration and any of a variety of edge dimensions configured to function with the needs of the system. The removable hair receptacles are configured to fit inside the hair receptacles of the quads.

Provided next is a spacer quad retrofit assembly. Each such assembly has a plurality of rectangular apertures and a support edge and is configured to removably couple to the bottom of the hair receptacles of the quads.

A tie down tool, that is configured to couple adjacent quads, is next provided. The tie down tool has a first end with a generally conical configuration and a second end having a pair of adjacent flanges of a flexible resilient material. The tie down tool is configured to facilitate the placement of the system. Further included is a securing hair aperture between the end quad and the side quad.

A secure device is provided and has a central hair aperture and a pair of wings each with a flange. The secure device is configured to rest over adjacent spines and secure to the system with the assistance of the tie down tool.

Next provided is a plurality of removable backing extension structures with a back face and at least one side edge.

Provided next is a hair manipulating tool. Such tool has a first end with tapered configuration and a pair rigid picks extending outward. Such tool has a second end with a first edge with a fine comb and a second edge with a plurality of projecting fingers with prongs. The prongs facilitate the application of the hair receptacles of the quads and is mateable with the quads.

A plurality of hinges of a generally rectangular configuration are next provided. The hinges have a first end configured to fit in the thin linear hinge receptacle of the quads and a second end and a pliable central portion.

Provided next are a plurality of channel sheets, each sheet having a long base surface with a plurality of divide walls forming a plurality of linear channels. A proximal ending has a linear aperture configured to receive the second end of the hinge and the proximal end having a female connector. Additionally, a distal end has a male connector to couple to other channel sheets to extend the length of the channel sheet.

Lastly provided is a hair clip which has a generally planar lower surface with a plurality of recesses. The recesses are configured to couple to divide walls of the channel sheet.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hair coloring system which has all of the advantages of the prior art systems for coloring hair of known designs and configurations and none of the disadvantages.

It is another object of the present invention to provide a new and improved hair coloring system which may be easily and efficiently manufactured and marketed.

It is further object of the present invention to provide a new and improved hair coloring system which is of durable and reliable constructions.

An even further object of the present invention is to provide a new and improved hair coloring system which is susceptible of a low cost of manufacture with regard to both materials and labor, and which accordingly is then susceptible of low prices of sale to the consuming public, thereby making such hair coloring system economically available to the buying public.

Even still another object of the present invention is to provide a hair coloring system for applying dye to hair in a safer and more precise manner.

Lastly, it is an object of the present invention to provide a new and improved hair coloring system having a grid body with a front bar and a rear bar each with a top edge and a concave bottom edge. A pair of side bars are constructed of a plurality of paired spines, a first spine projecting upwardly perpendicularly and a second spine having a proximal portion projecting outwardly and a distal portion projecting at an angle from the body. The side bar has a plurality of downwardly opening recesses and a plurality of radially extending fingers forming a linear trough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 63 is a side planar view of a hair block.

FIG. 64 is a view of the hair block of FIG. 63 taken along line 64-64 of FIG. 63.

FIG. 65 is a planar view of a cover sheet.

FIG. 66 is a view of the cover sheet of FIG. 65 taken along line 66-66 of FIG. 65.

FIG. 67 is an exploded view of the relation of the cover sheet, the channel sheet and the quad structure.

The same reference numerals refer to the same parts throughout the various Figures.

DESCRIPTION OF THE PREFERRED EMBODIMENT

Figure 1:
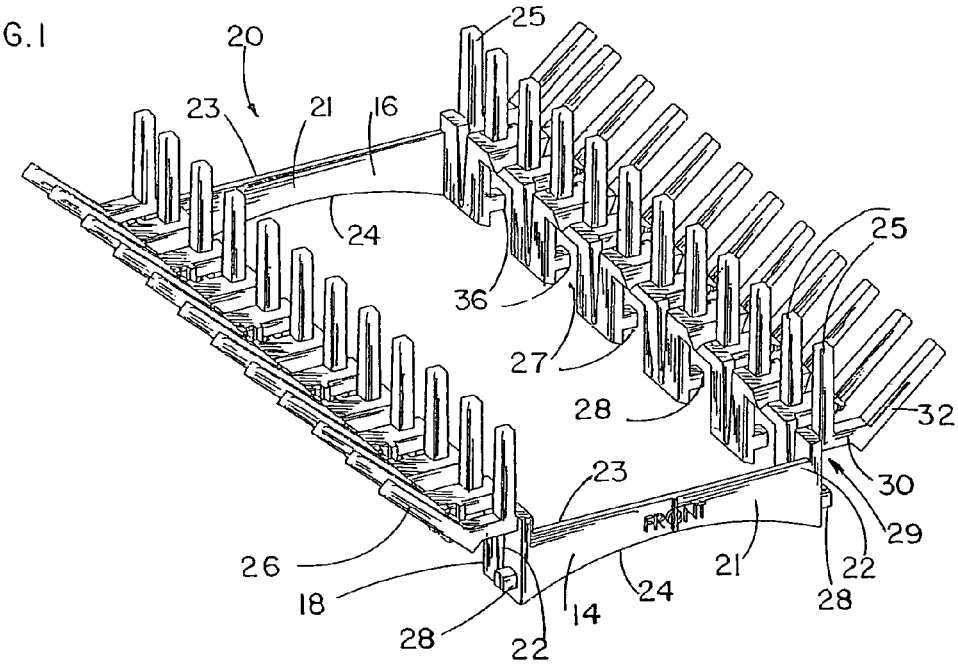
FIG. 1 is a perspective view of a grid body constructed for use with the system of the present invention.
Figure 2:
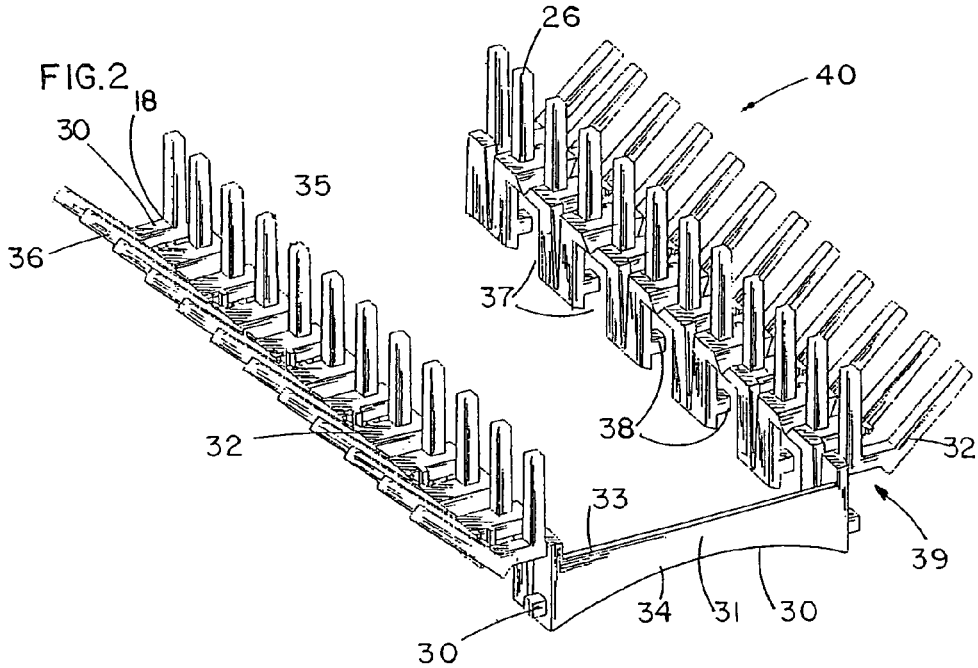
FIG. 2 is a perspective illustration of a grid body extension operable in association with the grid body shown in FIG. 1.
Figure 3:
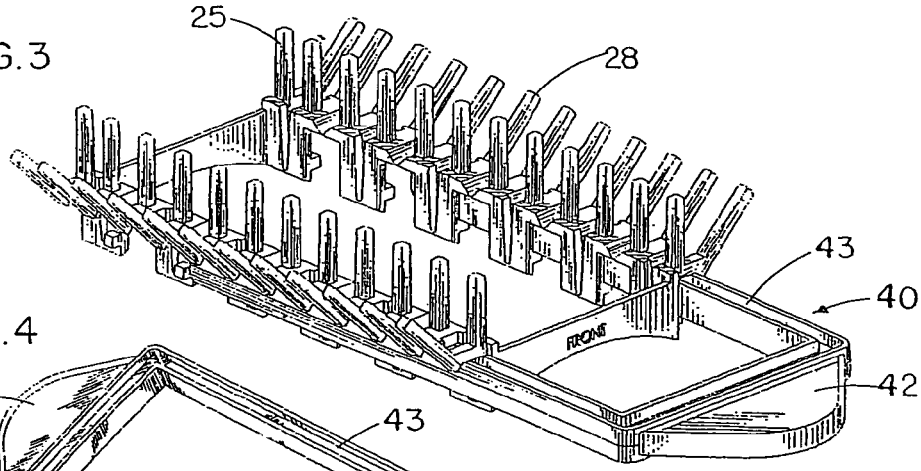
FIG. 3 is a perspective illustration of a grid body with an engaged coupling component.
Figure 4:
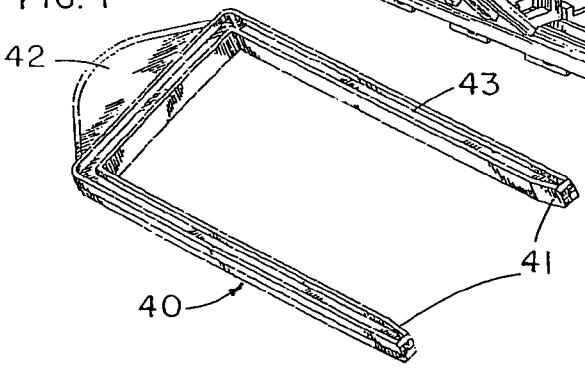
FIG. 4 is a perspective illustration of the coupling component shown in FIG. 3.
Figure 6:
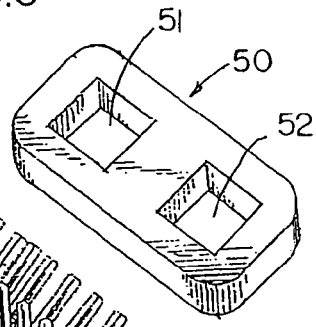
FIGS. 6, 7, and 8 are perspective illustrations of components of the system shown in the prior Figures.
Figure 5:
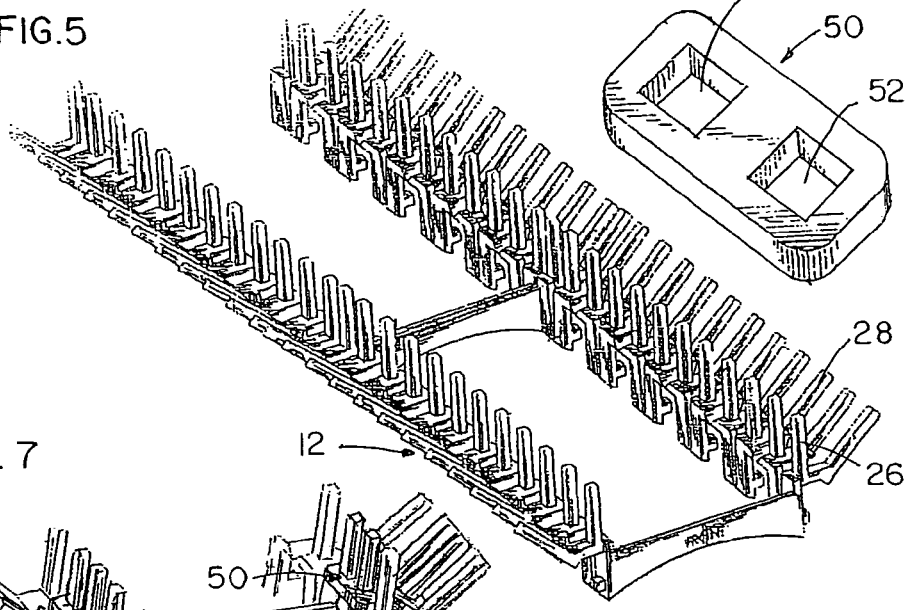
FIG. 5 is a perspective illustration of the grid body and grid body extension in a coupled orientation.
Figure 7:
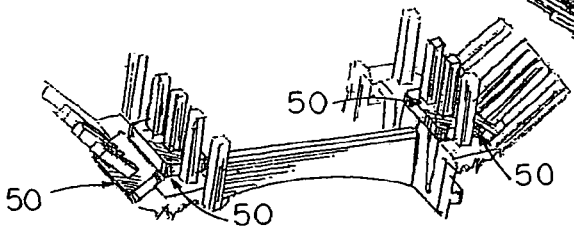
Figure 8:
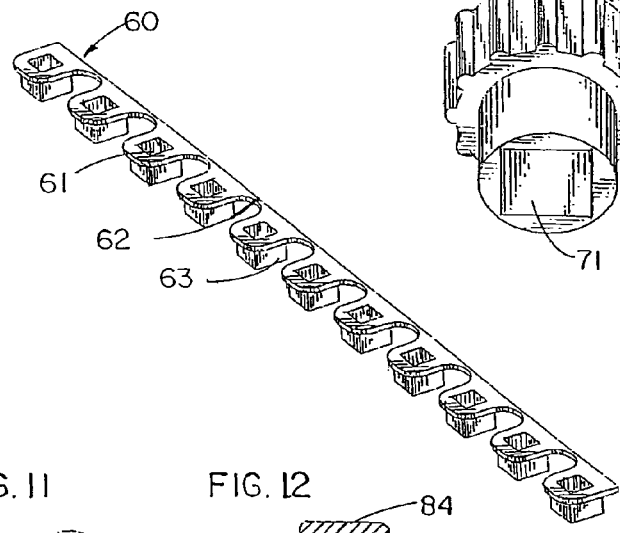
Figure 9:
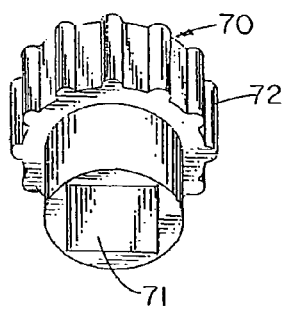
FIG. 9 is a perspective view of the cap.
Figure 10:
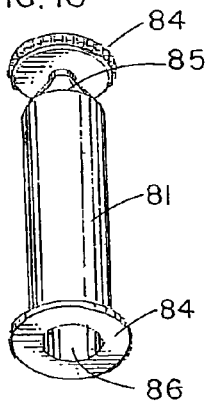
FIGS. 10, 11, and 13 are perspective illustrations of the components of FIG. 12.
Figure 11:
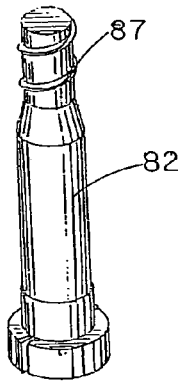
Figure 12:
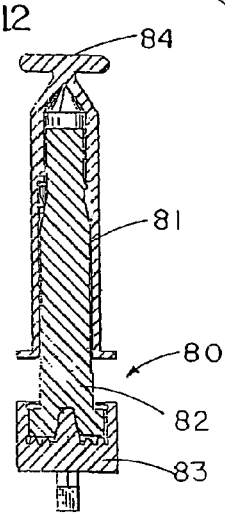
FIG. 12 is a cross-sectional view of an element configured to be used in association with the system shown in prior Figures and in FIGS. 10, 11 and 13 and as demonstrated in FIG. 59.
Figure 13:
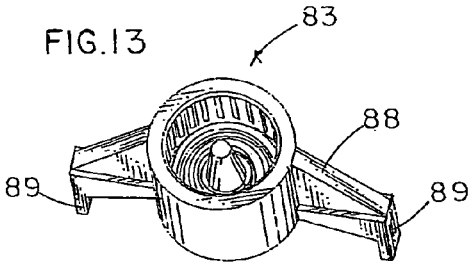
Figure 14:
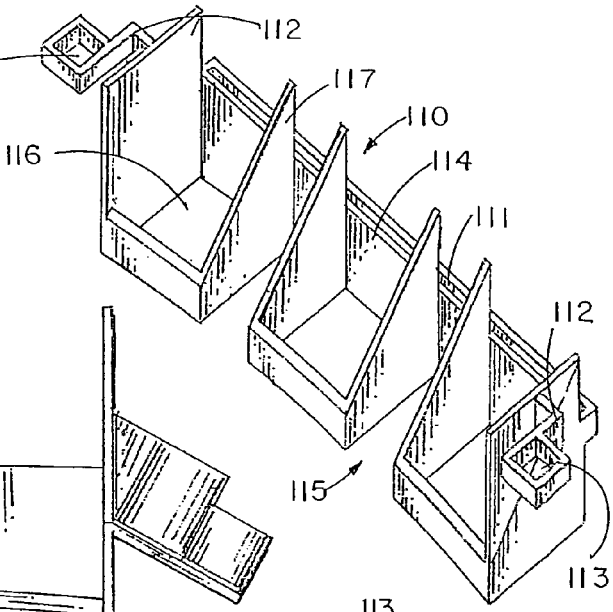
FIGS. 14 through 33 are perspective illustrations of components of the grid body and grid body extension shown in the prior Figures including minor variations and constructions thereof.
Figure 15:
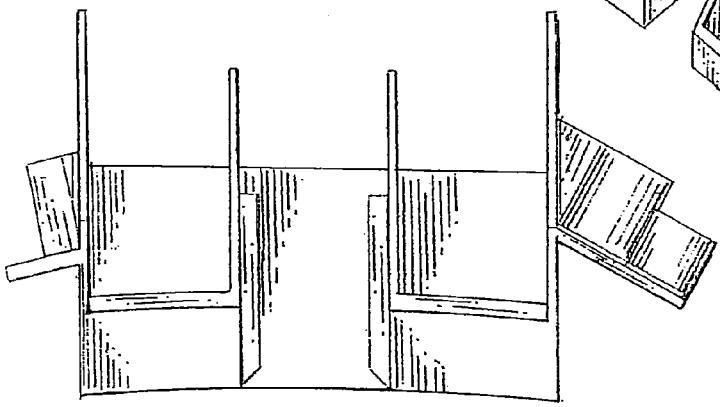
Figure 16:
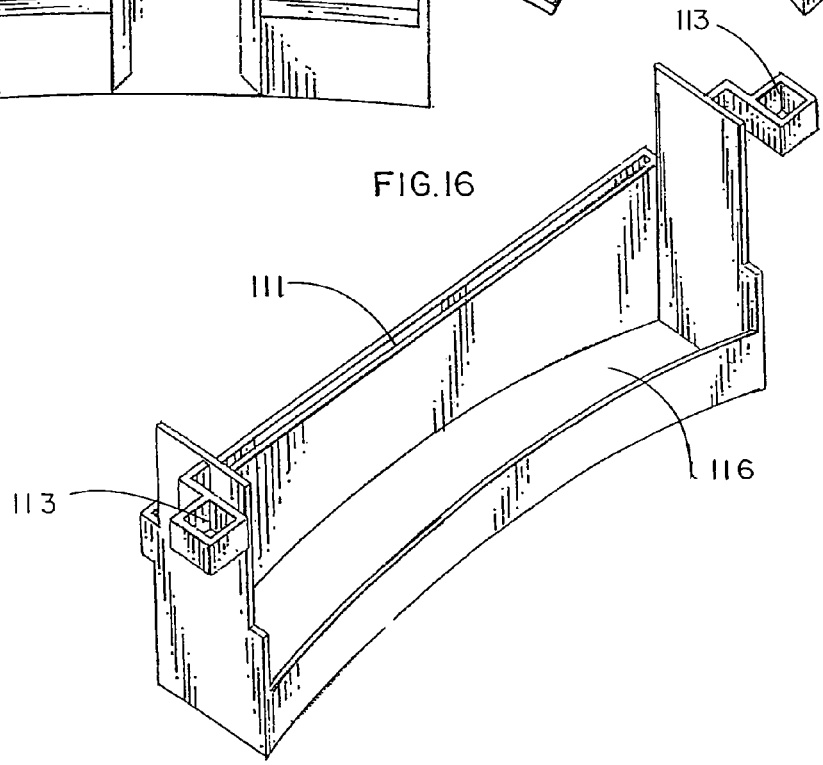
Figure 17:
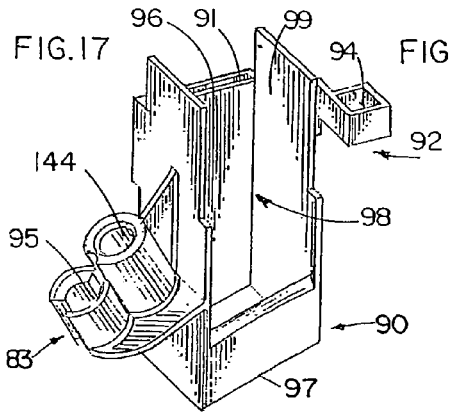
Figure 18:
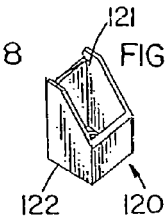
Figure 19:
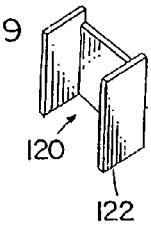
Figure 20:
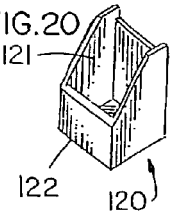

With reference now to the drawings, and in particular to FIG. 1 thereof, the preferred embodiment of the new and improved hair coloring system embodying the principles and concepts of the present invention and generally designated by the reference numeral 10 will be described.

The present invention, the hair coloring system 10 is comprised of a plurality of components. Such components in their broadest context include a grid body, a grid body extension, a lateral coupler, connectors, union strips, caps, hair curler apparatus, side quads, end quads, central quads, hair receptacles, a spacer quad retrofit assembly, a tie down tool, a secure device, backing extension structures, a hair manipulating tool, hinges, channel sheets and a hair clip. Such components are individually configured and correlated with respect to each other so as to attain the desired objective.

First provided in the hair coloring system 10 for applying dye to hair in a safer and more precise manner is a grid body 20. The grid body is preferably fabricated of a flexible transparent material but can be made of any rigid or semi rigid material. It has a pair of end bars 21 including a front bar and a parallel rear bar with a pair of parallel side bars 22 there between. The front bar and the rear bar each has a top edge 23 and a concaved bottom edge 24. The side bars are constructed of a plurality of paired spines each with a first spine 25 projecting upwardly perpendicular and a second spine 26 having a proximal portion projecting outwardly perpendicular and a distal portion projecting at an angle of about 45 degree from the perpendicular first spine. The side bars have a plurality of downwardly opening recesses 27 and a plurality of radially extending fingers 28 forming a linear trough 29.

A grid body extension 30 is fabricated of a rigid or semi-rigid material having a front bar 31 and a pair of parallel side bars 32 there between. Like the grid body, the grid body extension may be fabricated of rigid or semi-rigid material. The front bar has a top edge 33 and a concaved bottom edge 34. The side bars are constructed of a plurality of paired spines each with a first spine 35 projecting upwardly perpendicular and a second spine 36 having a proximal portion projecting outwardly perpendicular and a distal portion projecting at an angle of about 45 degree from the perpendicular first spine. The side bars have a plurality of downwardly opening recesses 37 and a plurality of radially extending fingers 38 forming a linear trough 39.

A lateral coupler 40 has a pair of linear prongs 41 and a handle portion 42 between the prongs. The lateral coupler has a continuous recess 43 around the periphery. The prongs are adapted to slidably couple with the linear troughs of the grid body and the grid body extensions.

A plurality of connecters 50 have a generally rectilinear configuration with a pair of apertures 51, 52 including a first aperture 51 and a second aperture 52. The apertures are configured to couple the grid body to a grid body extension such that the first aperture is configured to receive the spine of the grid body and the second aperture configured to receive the adjacent spine of the grid body extension. Thereby formed is an elongated grid structure.

Also provided is at least one union strip 60. The union strip has a generally linear configuration with a plurality of receiving apertures 61 and with a linear edge 62 adjacent to the apertures and further having at least one U-shaped indentation 63 therein. The receiving aperture is configured to receive the spine of the grid body and grid body extension so as to be removably coupled thereto.

A plurality of caps 70 are provided with each cap having a receiving end 71 and a grip end 72. The receiving end is adapted to be removably coupled to the spines.

A hair curler hold-down apparatus 80 has a hollow exterior portion 81 of a generally cylindrical configuration and a solid interior portion 82 of a generally frustoconical configuration and a hair curler cap 83. The exterior portion of the hair curler hold-down apparatus has a pair of disk ends 84 and a tapered, closed upper part 85 and an open bottom 86. The interior portion of the hair curler hold-down apparatus has a threaded end 87. The hair curler cap has a pair of wing sides 88 with fingers 89. The hair curler apparatus functions by coupling with a strand of hair from a user's scalp and the grid or quads. The hair curler hold-down apparatus is then rotated so as to spool up the hair, thereby pulling the hair curler apparatus, and the coupled quad or grid, toward the scalp.

A plurality of side quads 90 is next provided. Each side quad has a support backing with a thin linear hinge receptacle 91 and an interior end 92 and an exterior end 93. The interior end has a first coupler 94 configured to slidably couple to the second spines of the grid body and the grid body extension.

The exterior end has a second coupler 95. The support backing has a linear top edge 96 and an concaved bottom edge 97 and at least one hair receptacle 98 thereon. Each of the hair receptacle has fins 99. The hair receptacle defines a hair passageway. The side quad may couple to the grid of may couple to another side quad.

Next provided is a plurality of end quads 100. Each has a support backing with a thin linear hinge receptacle 101 and an interior end 102 with a first coupler 103 and an exterior end 104 with a second coupler 105. The first coupler is configured to couple to the second coupler of the side quads. The support backing has a linear top edge 106 and an concaved bottom edge 107 and a plurality of hair receptacles 108 thereon, the hair receptacles defining a hair passageway. Each of the hair receptacles has fins 109.

Additionally, a plurality of central quads 110 are provided. Each has a support backing with a thin linear hinge receptacle 111 and a pair of side ends 112. The side ends each has side couplings 113 configured to slidably couple to the first spines of the grid body and the grid body extension on both ends of the central quad. The support backing has a linear top edge 114 and an concaved bottom edge 115 and a plurality of hair receptacles defining a hair passageway 116 thereon. Each of the hair receptacles has fins 117.

Figure 22:
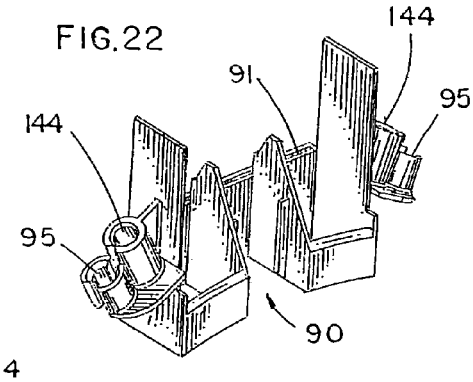
Figure 23:
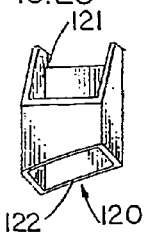
Figure 24:
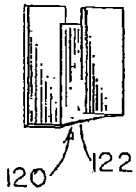
Figure 25:
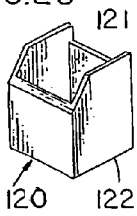
Figure 26:
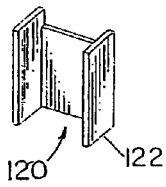
Figure 27:
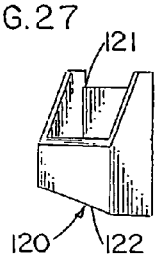
Figure 28:
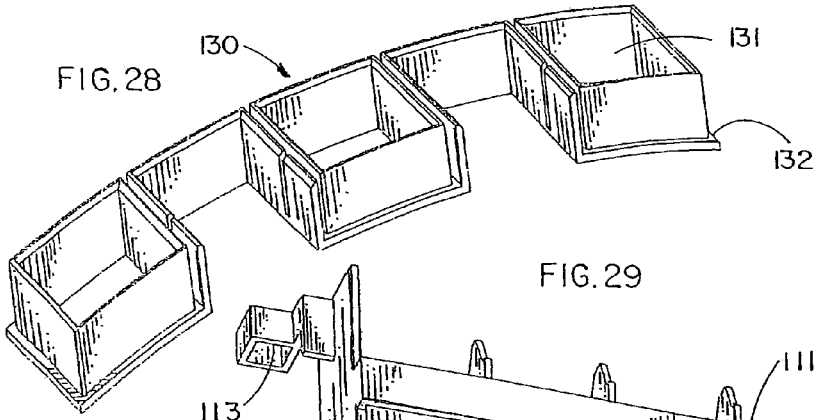
Figure 29:
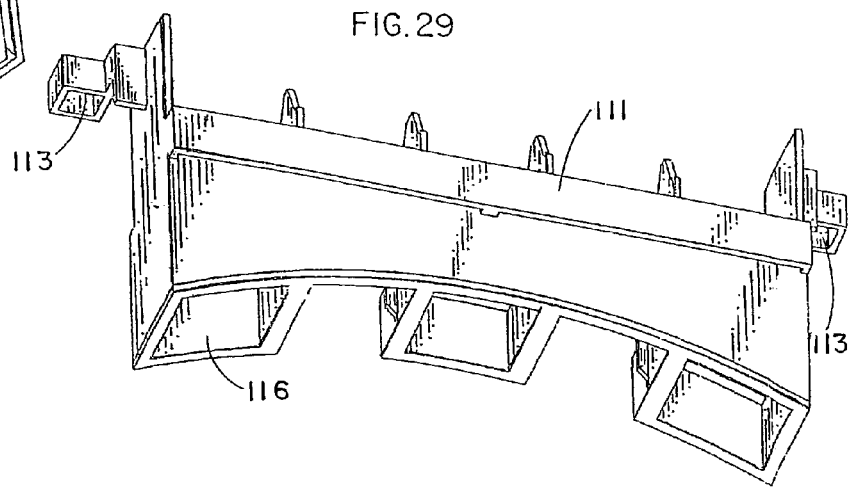
Figure 30:
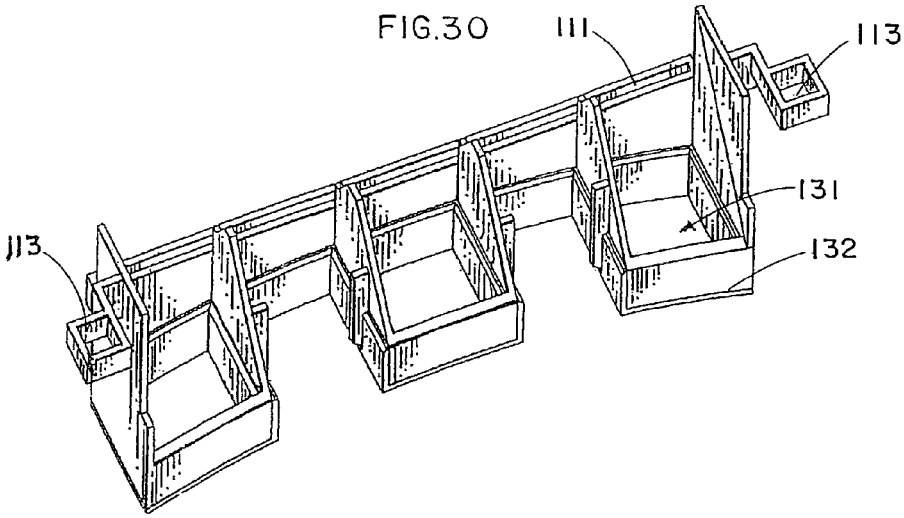
Figure 31:
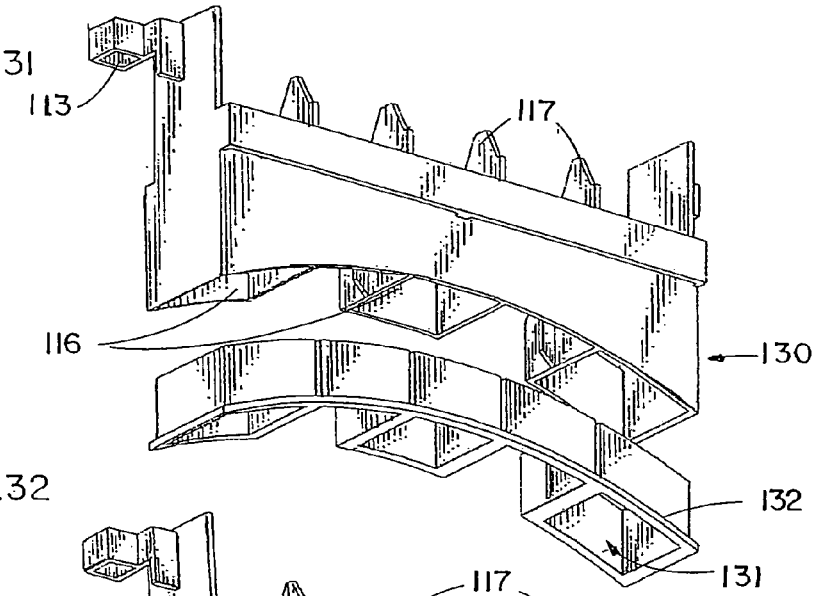
Figure 32:
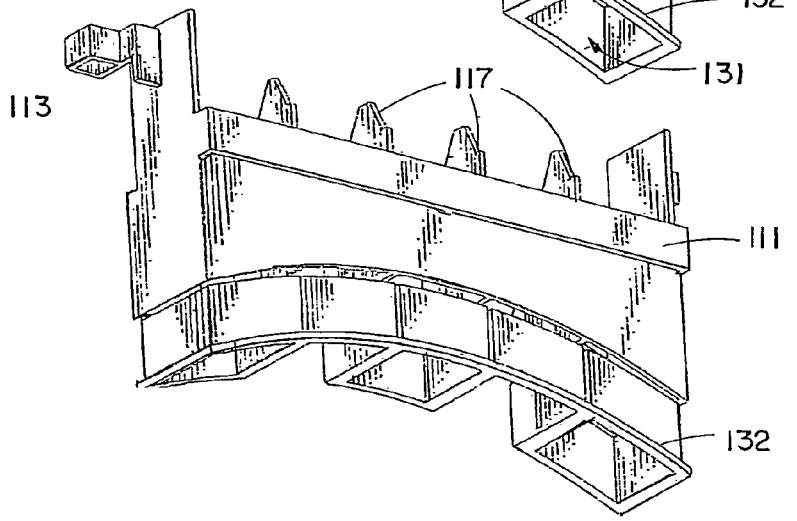
Figure 33:
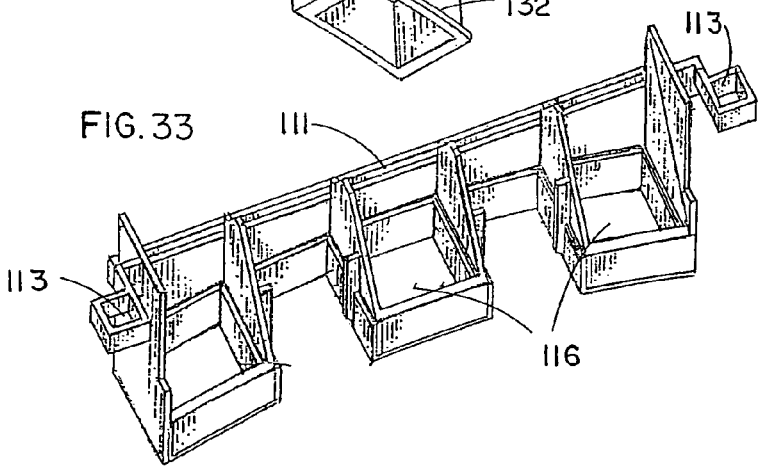
Figure 34:
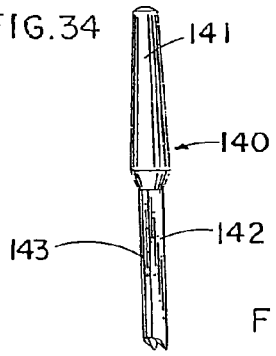
FIGS. 34 through 38 are perspective illustrations of a tie-down tool configured to join one component to another and to provide contour to various components of the system of the prior Figures.
Figure 35:
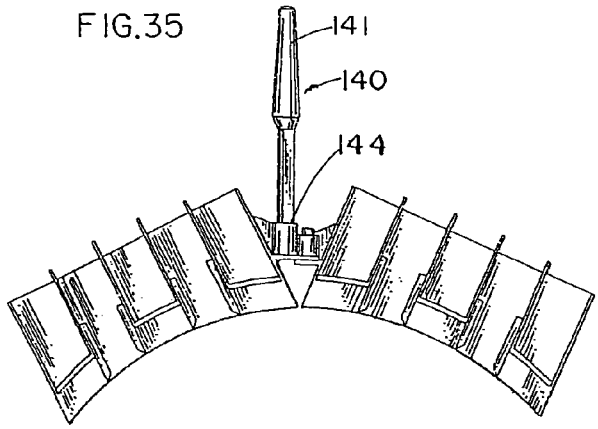
Figure 36:
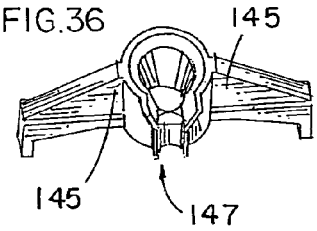
Figure 37:
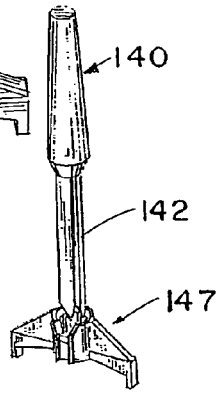
Figure 38:
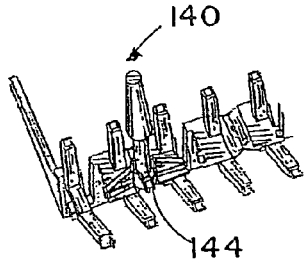
Figure 39:
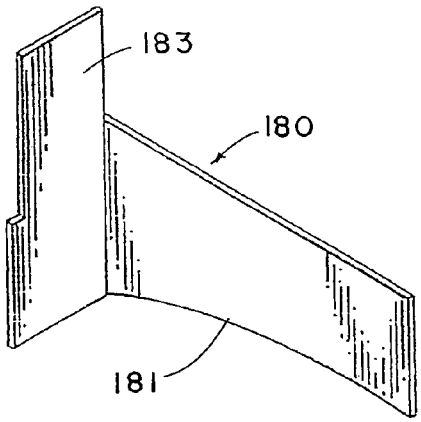
FIGS. 39 and 40 are perspective illustrations of end components configured for use in the system of the present invention.
Figure 40:
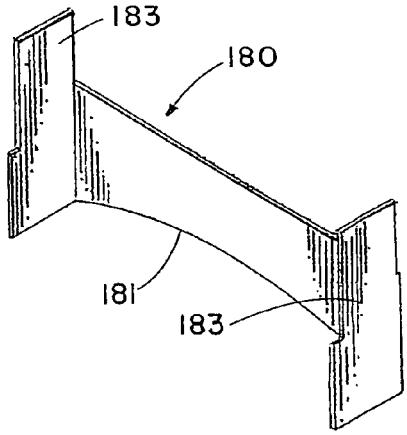
Figure 41:
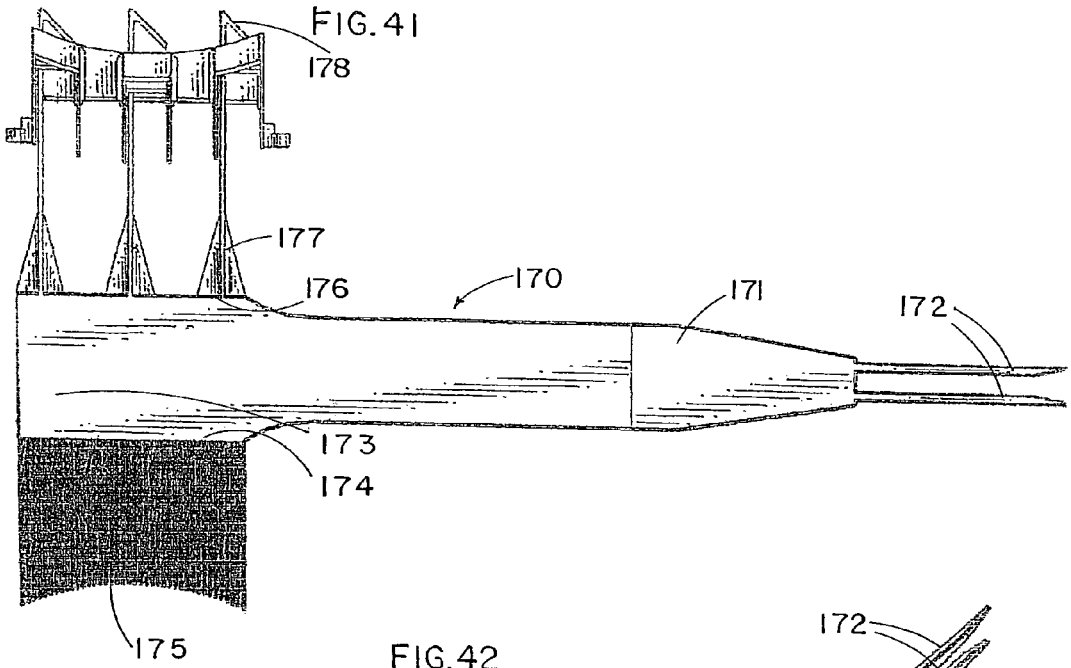
FIGS. 41 and 42 are perspective illustrations of a hair manipulating tool configured for use in association with the quad component and grid body of the prior Figures.
Figure 42:
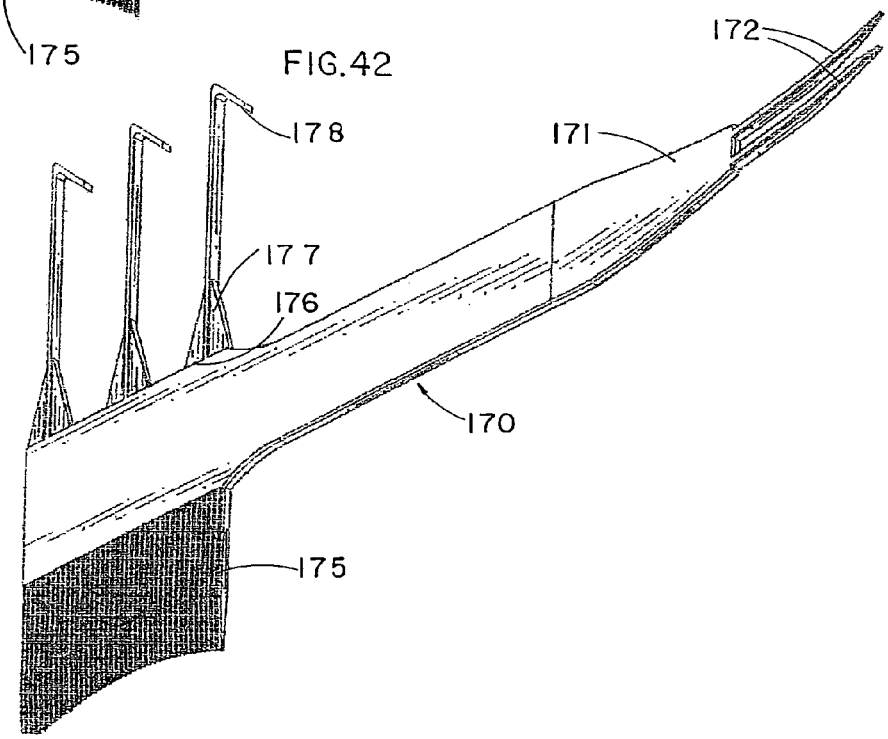
Figure 43:
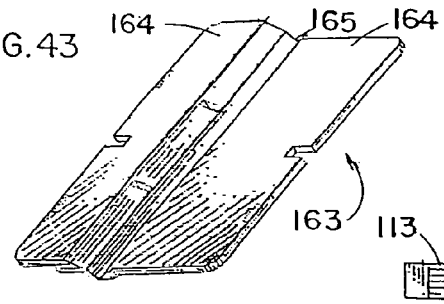
FIGS. 43 through 58 are perspective illustrations of the various components of the system shown in the prior Figures.

In alternate embodiments the quad structures may be configured to allow the quad to be used with other quad structures, without the utilization of the grid. In this configuration, the quad would be configured to have a second coupler as depicted by number 95 of FIG. 22. In addition to the second coupler could also be a hair aperture, number 144, FIG. 22, with which to couple the quad to the scalp. It should be understood that the quads may be coupled to each other, or be used alone, depending on the type of hair coloration desired, and the effect desired. Quads may or may not have hair apertures. Quads may also have only one second coupler on one end of the quad. In an alternate embodiment, the quad may only have hair apertures, without any second couplers.

A plurality of removable hair receptacles 120 have a generally rectangular interior configuration 121 and any of a variety of edge dimensions 122. They are adapted to function with the needs of the system and are adapted to fit inside the hair receptacles of the quads.

A spacer quad retrofit assembly 130 is made of a flexible material and has a plurality of rectangular apertures 131 and a support edge 132. It is adapted to removably couple to the bottom of the hair receptacles of the quads. In order to accommodate different surface irregularities between different users, the spacer quad retrofit assembly functions as a form of gasket, to allow the user to seal the space between the scalp and the quad.

A tie down tool 140 is configured to couple adjacent quads. It has a first end 141 with a generally conical configuration and a second end 142 with a split shaft 143. In usage, a strand of hair is captured within the split shaft of the tie down tool. The tool is then inserted in the receptacle of the quad and the tool is rotated. The hair aperture 144 between the end quad and the side quad is configured to receive the tool. The turning causes the tool, and the quad, to be drawn toward the scalp. The tie down tool may be used in any location away from the receptacle. For this purpose, the tie down tool has an associated end piece 147, with the end piece having a pair of adjacent wings 145. The wings form a bearing surface against a location where it is employed. The tool and end piece are preferably fabricated of a rigid or semi-rigid material and are configured to facilitate the placement of the system.

Of course, it is recognized that in alternate embodiments any one of a plurality of means may be used to secure the system to a user's scalp. Such means include, but are not limited to, using ties around the chin and coupling the ties to the grid or quads. Also included is the method of and using straps to pull the system into place.

Figure 21:
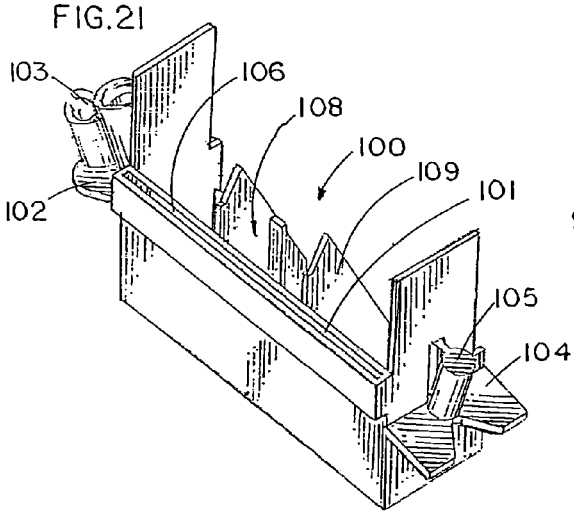
Figure 44:
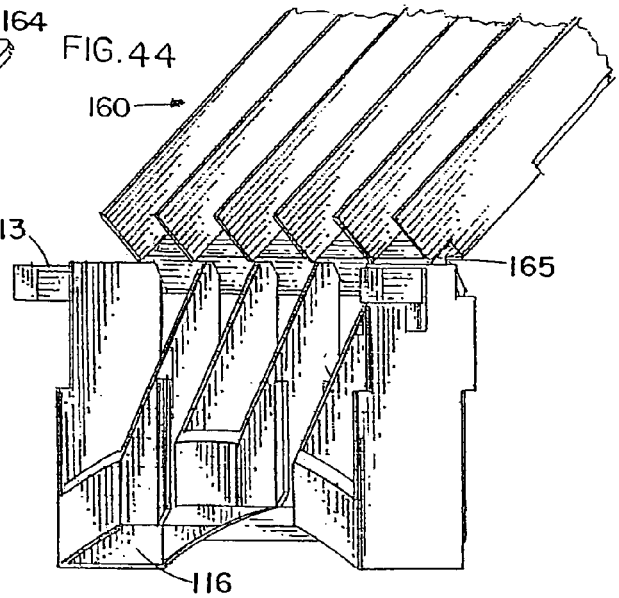
Figure 45:
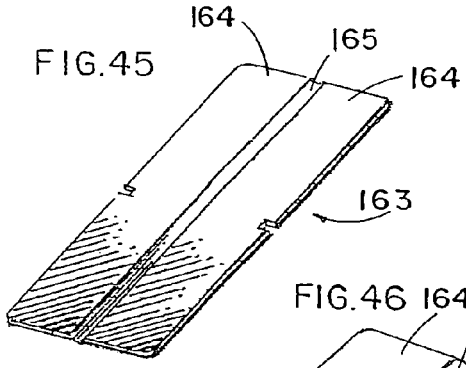
Figure 46:
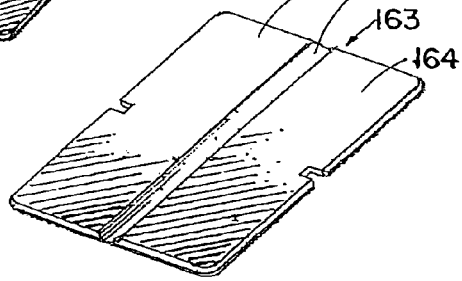
Figure 47:
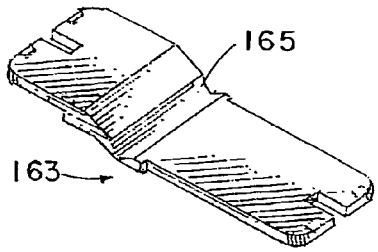
Figure 48:
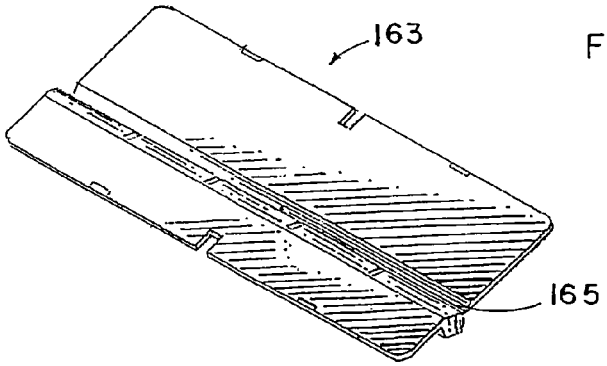
Figure 49:
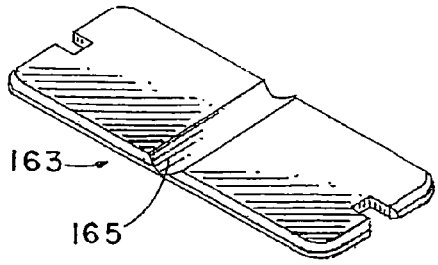
Figure 51:
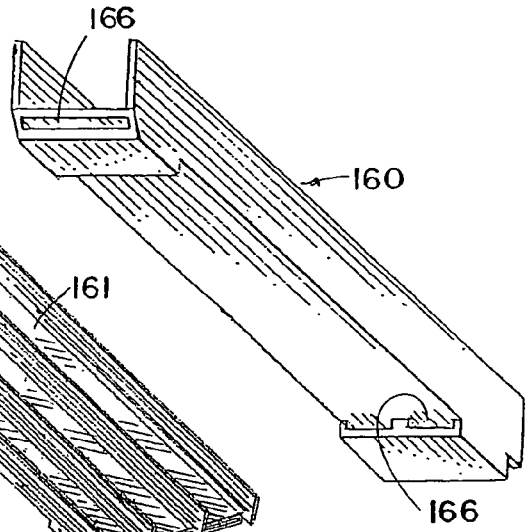
Figure 50:
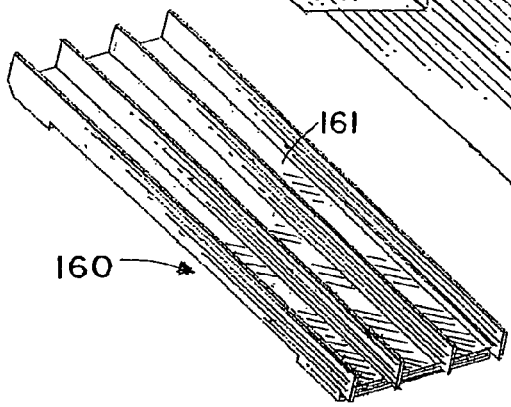
Figure 52:
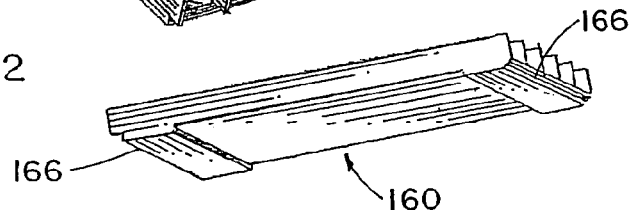
Figure 53:
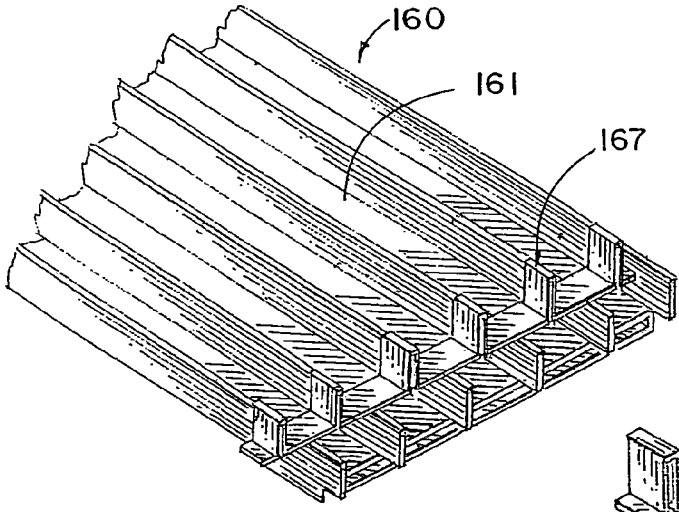
Figure 54:
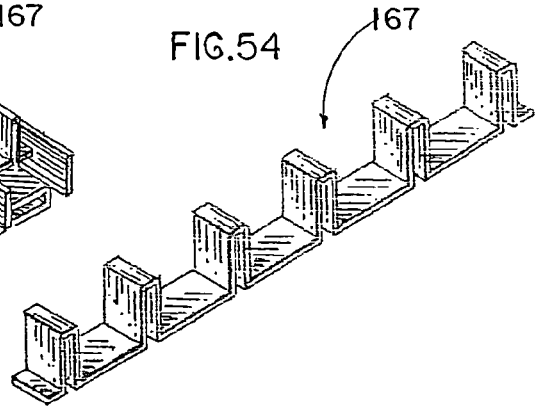
Figure 55:
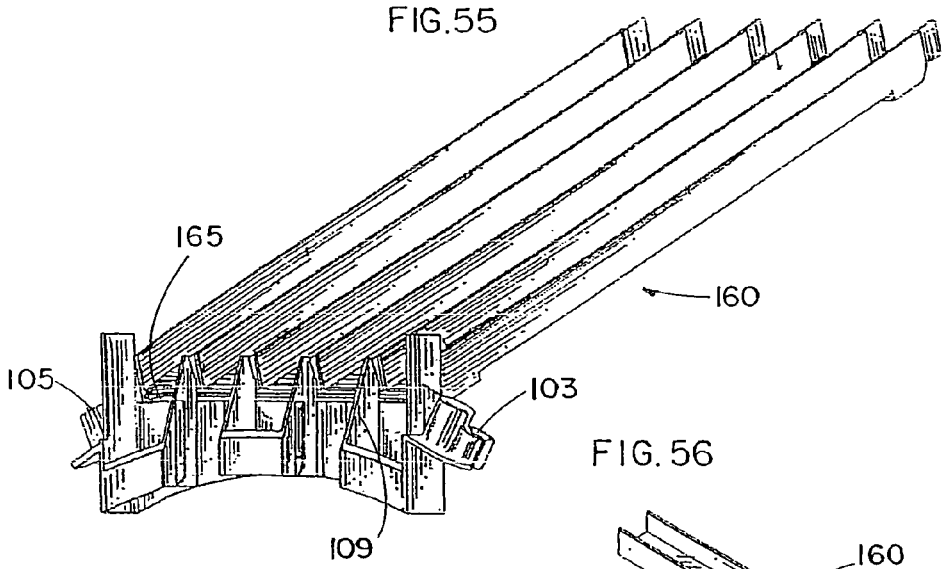
Figure 56:
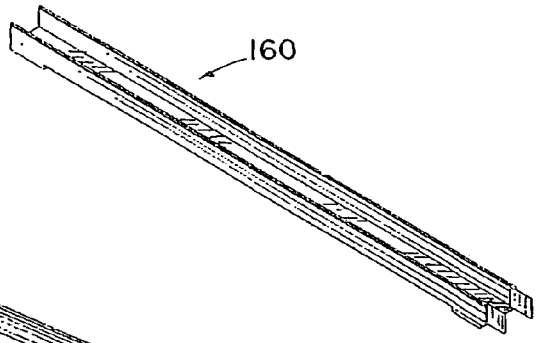
Figure 57:
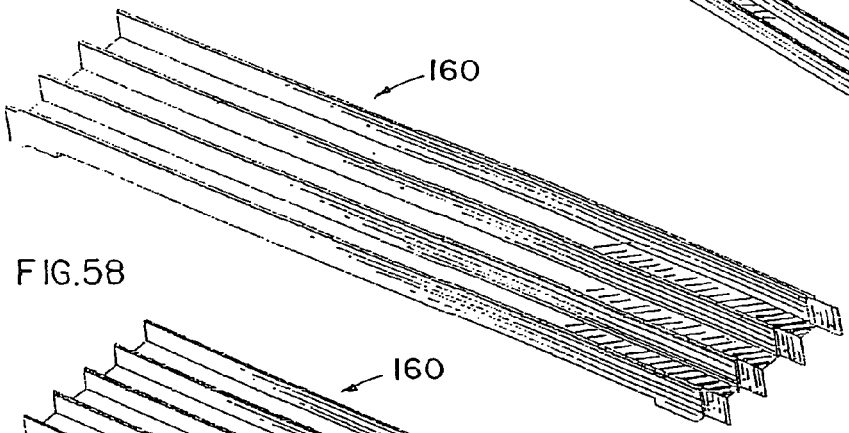
Figure 58:
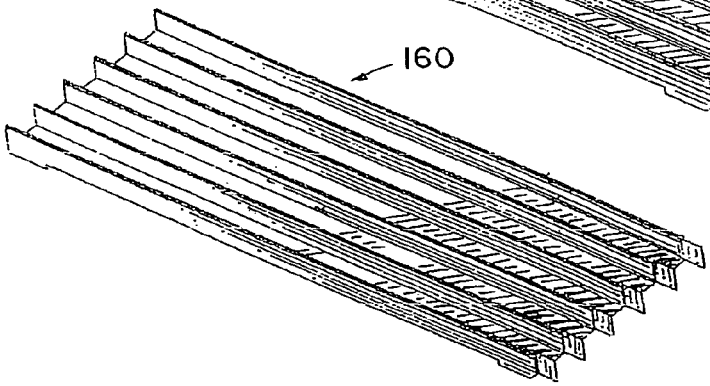
Figure 59:
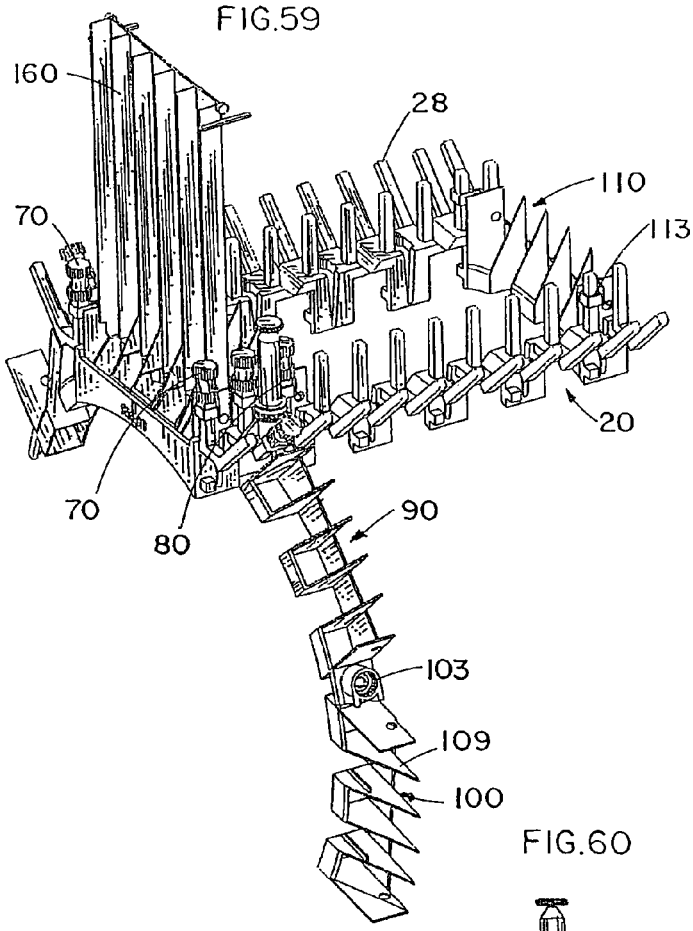
FIGS. 59 through 62 are perspective illustrations of the components of the present invention in systems configuration.
Figure 60:
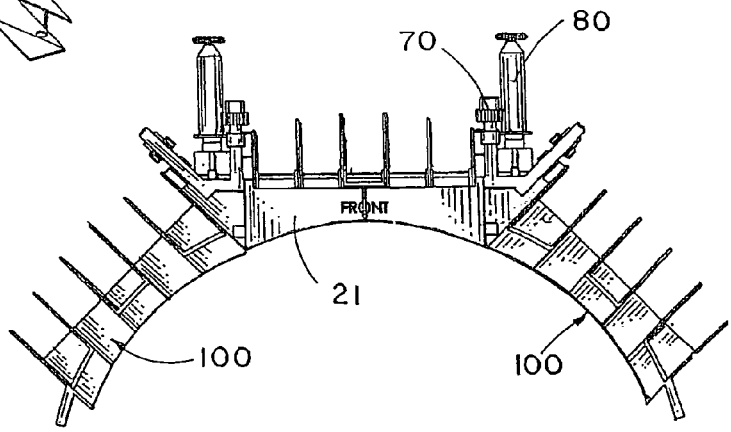
Figure 61:
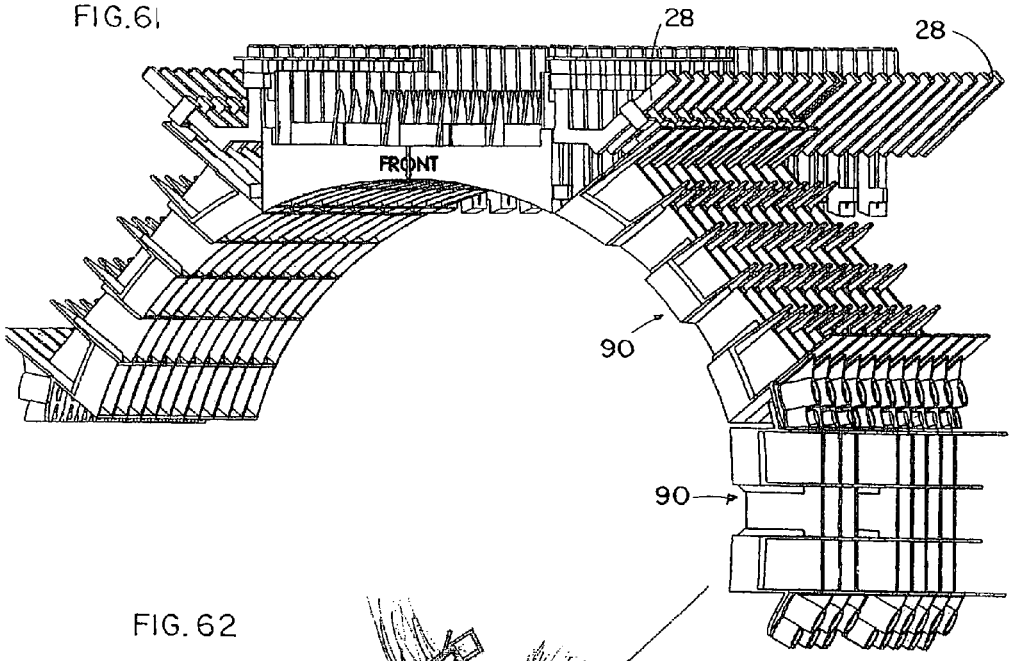
Figure 62:
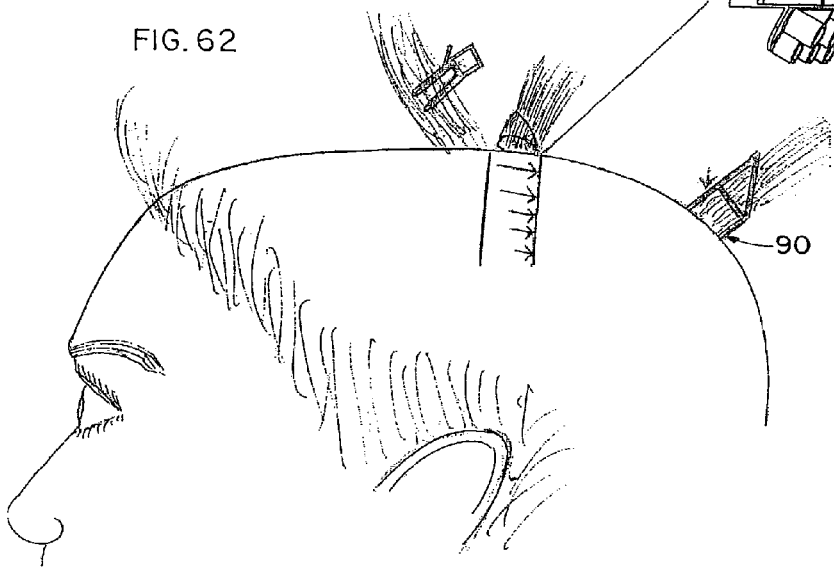
Figures 68, 68A:
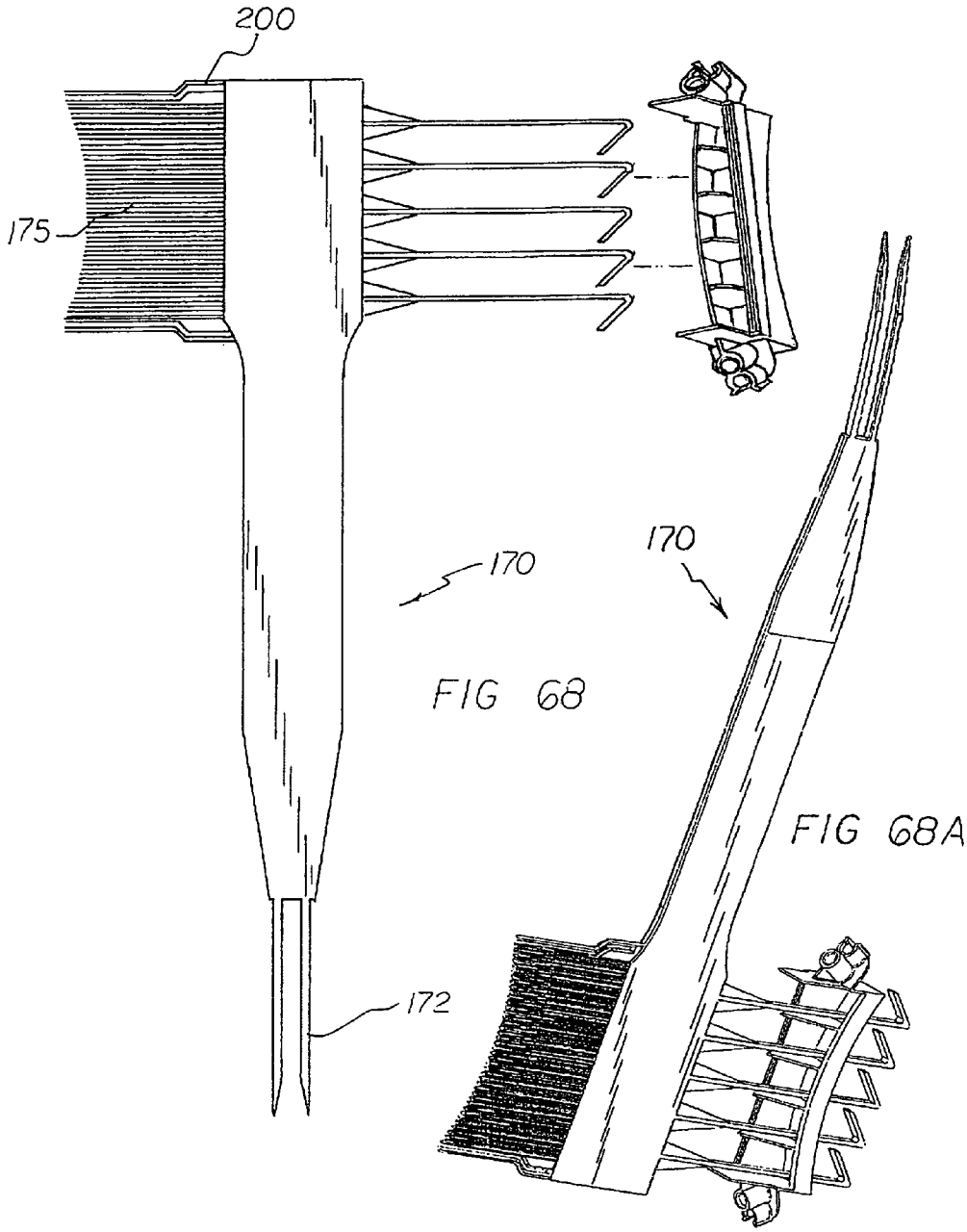
FIG. 68 is an exploded view of a hair manipulating tool demonstrating the angled protuberances.
FIG. 68A is a planar view of the tool shown in FIG. 68.

Provided next is a plurality of removable backing extension structures 160 also referred to as channel sheets, each with a face 161. The channel sheet may have a single passageway or chute, or it may have separated passageways or chutes. Each chute, or passageway, of each channel sheet has a pair of generally parallel-ly oriented walls 221 as shown in FIGS. 44, 50-53, and 55-58. The channel sheets are coupled to the quads with a hinge plate 163. The hinge plate is located at an end of the channel sheet with the hinge lying parallel with the end of the channel sheet. The hinge plate has two rigid sections 164 and a flexible movable section 165. As can be seen in FIG. 44, the hinge has a flexible movable section having a length that runs from side to side. The length of the flexible movable section is located perpendicular to the hair receptacle 98 of the side quad, as can be seen in FIGS. 21 and 44. One should note that reference to 116 is that of reference to a hair receptacle of a central quad, which has a different configuration from that of a side quad. While the constructs of the hair receptacles are similar, the overall construct of a side quad and a central quad are different. Separate and different numbers were used to differentiate between the hair receptacle of the side quad and the hair receptacle of the central quad. One skilled in the art would recognize that the hinge plate rotates about the flexible movable section and enables the hinge action to be in an orientation that is perpendicular to the hair receptacle passageway, as seen in FIG. 44. The hinge may be rectilinear or it may have any configuration, such as a stepped configuration. The hinge plate may have any geometrical configuration. The rigid part of the hinge plate mates with the hinge receptacle 111 and the channel sheet hinge receptacle 166, coupling the two. The channel sheets may be coupled to one another so as to extend the length of the channel sheet. The channel sheet may have an associated hair clip 167 associated there with.

A hair block 168 may be used with a channel sheet. The hair block has a lower portion 169 and an upper gripping portion 179. The lower portion has a general rectilinear configuration and lies in a first plane. The hair block is sized to be snuggly fit into a channel sheet. The upper gripping portion is oriented perpendicular to the lower portion and forms a surface for gripping the hair block. In operation, a gather of hairs is placed within the walls of the channel sheet. The hair block is then placed over the gather of hairs, and when the block is pressed into the space between the walls of the channel sheet, the block engages the walls with a snug fit and thereby holds the gather of hairs in position within the walls of the channel sheet. This allows die to be separated from one gather of hair to the next by the walls of the channel sheet. The block maintains the gather of hairs in position by being snuggly fit between the channel sheet walls, and does not allow the gather to contact other gathers of hairs.

A channel cover 190 may be used in association with the channel sheet. The channel cover has a generally rectilinear configuration with two side edges 191. The side edges are displaced in a downward direction perpendicular to the channel cover. The channel cover has a plurality of slots 192 to mate with the quad.

A hair manipulating tool 170 has a first end 171 with tapered configuration and having a pair rigid picks 172 extending outward. A second end 173 with a first edge 174 with a fine comb 175 and a second edge 176 with a plurality of projecting fingers 177 with angled prongs 178 there functions to facilitate the application of the hair receptacles of the quads.

Figure 69:
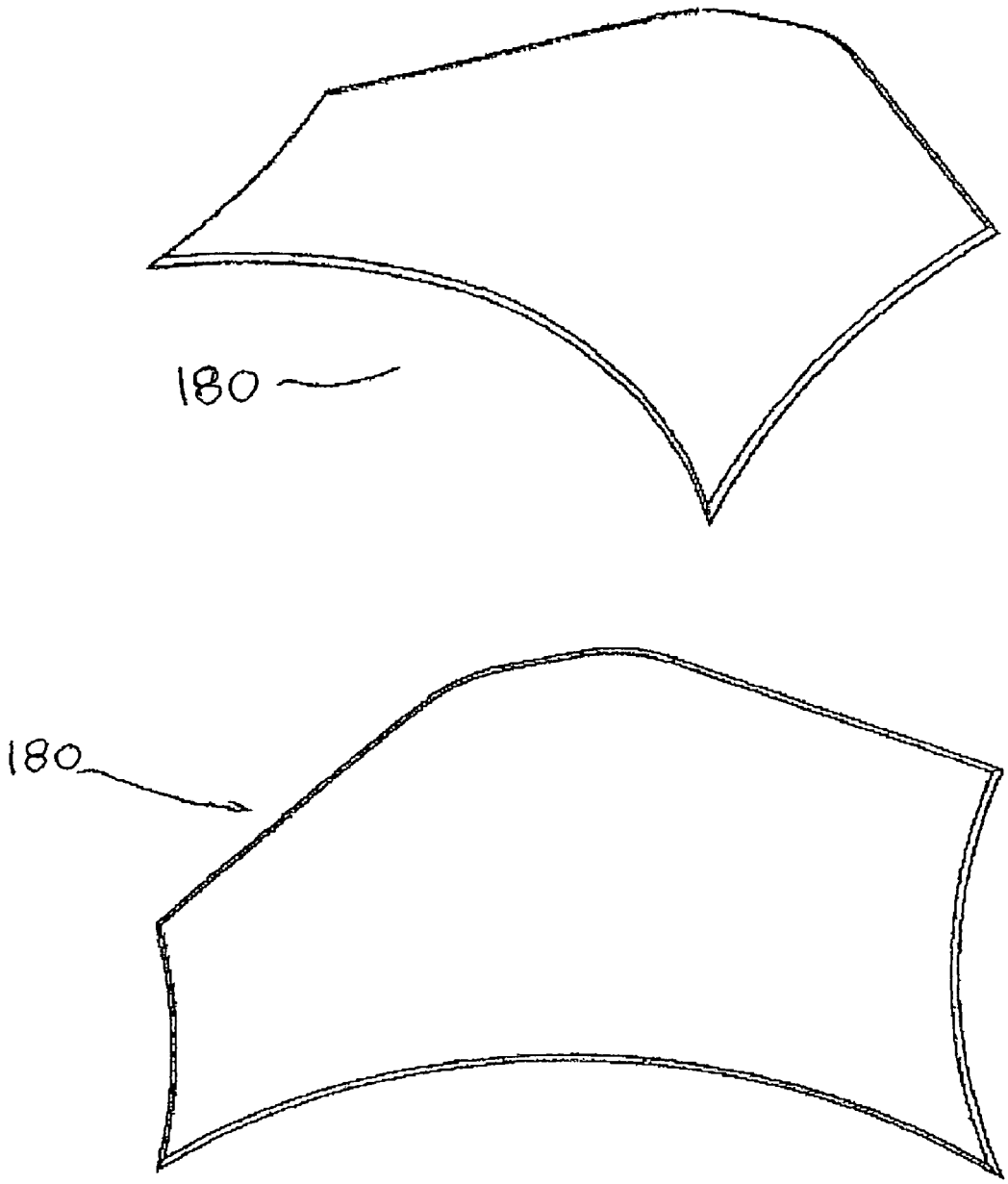
FIG. 69 is a planar view of the straight edge tool.

In an alternate embodiment the hair manipulating tool may further comprise the comb having at least one angled protuberance 200 being located in the same plane as the comb. Associated with the hair manipulating tool is a straight edge 180. The straight edge is used to guide the rigid picks in a straight line across the scalp. The straight edge has a curved lower edge 181 for allowing a close fit with the contour of the scalp and a rigidity support structure. As can be seen in FIG. 69, the straight edge is generally a flat planar structure with a curved edge configured to fit against a scale contour.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hair coloring system comprising, in combination:

a grid body having a concaved bottom edge and a plurality of downwardly opening recesses;

a grid body extension having a concaved bottom edge;

a lateral coupler having a pair of linear prongs;

a plurality of connecters having a generally rectilinear configuration with a pair of apertures including a first aperture and a second aperture and being configured to couple the grid body to a grid body extension such that the first aperture is configured to receive the spine of the grid body and the second aperture configured to receive the adjacent spine of the grid body extension thereby forming an elongated grid structure;

a plurality union strips;

a plurality of caps having a receiving end and a grip end;

a hair curler apparatus having a hollow exterior portion of a generally cylindrical configuration, a solid interior portion of a generally frustoconical configuration and an end cap;

a plurality of side quads each having a hinge receptacle;

a plurality of end quads each having a hinge receptacle;

at least one central quad having a hinge receptacle and a pair of side ends;

a plurality of removable hair receptacles configured to fit inside the quads;

a tie down tool configured to couple adjacent quads;

a hair manipulating tool having a first end with tapered configuration and having a pair rigid picks extending outward, a second end with a first edge with a fine comb and a second edge with a plurality of projecting fingers with prongs to facilitate the application of the hair receptacles of the quads;

a plurality of channel sheets having a proximal ending having a linear aperture configured to receive a hinge; and a hair block having a generally planar lower surface coupleable to the channel sheet.

2. A hair coloring system comprising:

a quad having at least three sides defining a hair receptacle passageway, with the quad having an associated tie down tool;

at least one channel sheet having an end and having a hinge plate having two rigid portions and a flexible movable section there between, the hinge plate being interposed between the quad and the channel sheet with the hinge being located at the end of the channel sheet, the hinge being parallel with the end of the channel sheet and perpendicular to the hair passageway of the hair receptacle; the channel sheet having at least two parallelly oriented separating walls;

a channel cover, the channel cover having a generally rectilinear configuration with two side edges with the side edges being displaced in a downward direction perpendicular to the channel cover, the channel cover having a plurality of slots to mate with the quad; and a hair block having a generally planar lower surface coupleable to the channel sheet by fitting snugly between and engaging the separating walls of the channel sheet.

* * * * *